United States Patent [19]

O'Neil

[11] 3,971,077

[45] July 27, 1976

[54] ADJUSTABLE HEIGHT CLOSET SEAT ASSEMBLY

[75] Inventor: Robert O'Neil, Wheaton, Ill.

[73] Assignee: Beneke Division, Beatrice Foods Co., Columbus, Miss.

[22] Filed: Mar. 10, 1975

[21] Appl. No.: 557,168

[52] U.S. Cl. ..... 4/239

[51] Int. Cl.[2] ..... A47K 13/00

[58] Field of Search ..... 4/237, 235, 239, 240; 297/250, 253, 255, 257

[56] References Cited

UNITED STATES PATENTS

| | | | |
|---|---|---|---|
| 2,554,422 | 5/1951 | Richards et al. | 4/239 |
| 2,790,182 | 4/1957 | Malin | 4/237 |
| 2,928,104 | 3/1960 | Kennedy | 4/237 |
| 2,980,922 | 4/1961 | Taylor | 4/235 |
| 3,060,458 | 10/1962 | Burke | 4/237 |
| 3,086,223 | 4/1963 | Grass | 4/237 |
| 3,364,505 | 1/1968 | Palmier | 4/239 |
| 3,392,411 | 7/1968 | Hansen | 4/239 |
| 3,490,082 | 1/1970 | Murcett | 4/239 |
| 3,594,831 | 7/1971 | Brewer | 4/237 |

*Primary Examiner*—Henry K. Artis
*Attorney, Agent, or Firm*—Francis A. Keegan

[57] ABSTRACT

A water closet seat assembly with a closet seat for use in an elevated or a conventional position. The seat assembly includes support walls mounted on opposite sides of the water closet and provided with two vertical and opposed guideways. The closet seat has a central opening for access to the receptacle and guides which project into the guideways and are free to slide and pivot therein. Support protrusions project inwardly from the support walls to support the closet seat in the elevated position. As the closet seat guides are moved to the bottom of the guideways, an extended lip portion of the closet seat which rests on the support protrusion, moves rearwardly to clear the protrusions and permit the closet seat to be lowered to its conventional position adjacent the upper edge of the water closet receptacle. Arm rests may extend from the walls to provide support for the arms of the user.

14 Claims, 5 Drawing Figures

ADJUSTABLE HEIGHT CLOSET SEAT ASSEMBLY

BACKGROUND OF INVENTION

This invention relates generally to water closet seats and more particularly to closet seats which may be raised to a preselected elevated position for those unable to use the closet seat at the conventional height.

In the past, water closet seats have been constructed primarily for use at a preselected height for all persons, old and young, healthy and infirm. Frequently, the height selected was not suitable for the elderly or infirm persons who find it difficult, if not impossible, to raise themselves from the low seating positions which have previously been selected. Elevated seating positions are desirable and often necessary for use in hospitals, nursing homes and elsewhere to properly provide care for those in need.

Additionally, it is highly desirable to achieve multiple use for a closet seat assembly having an elevated position by providing a conventional height position for use by those not requiring the elevated position.

The prior art closet seat assemblies have not provided assemblies which could be raised to an elevated position while providing a closet seat which may be tilted in the conventional manner to provide easy access for cleaning the receptacle of the closet. The prior art assemblies which could be raised to an elevated position have required support structure which is attached to the floor adjacent the water closet thereby making it difficult to maintain the assemblies in proper sanitary condition.

OBJECTS OF THE INVENTION

The principal object of the present invention is to provide an improved closet seat assembly for a water closet.

Another object of the present invention is to provide an improved closet seat assembly in which the closet seat may be raised from a conventional position to a predetermined elevated position above the water closet.

An additional object of the present invention is to provide a closet seat assembly which may be raised to an elevated position and provides arm support for the user.

A further object of the present invention is to provide a closet seat assembly having a conventional and an elevated position which is simple to operate and attractive in appearance.

Another object of the present invention is to provide a closet seat assembly having a conventional and an elevated position which can be installed on a conventional water closet in a manner similar to conventional closet seats while keeping the floor adjacent the water closet clear of any support structure.

A still further object of the present invention is to provide a closet seat assembly which is easily raised to an elevated position as may be required for an invalid and yet may be simply and easily returned to a conventional height position for use by other persons.

Another object of the present invention is to provide a closet seat assembly which prevents splashing from between the seat and the water closet when the seat is raised to an elevated position above the water closet.

These and other objects of the present invention will become apparent upon careful review of the following specification and claims, including the accompanying drawings.

THE DRAWINGS

DESCRIPTION OF THE PREFERRED EMBODIMENT

Figure 3:
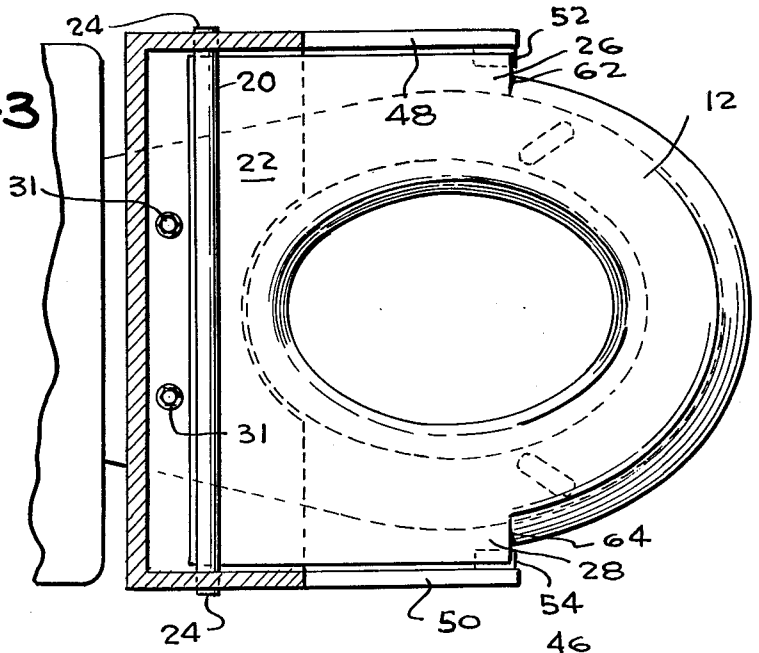
FIG. 3 is a fragmentary top view of the closet seat assembly taken along line 3—3 in FIG. 2 showing the closet seat resting on support protrusions in the elevated position.
Figure 1:
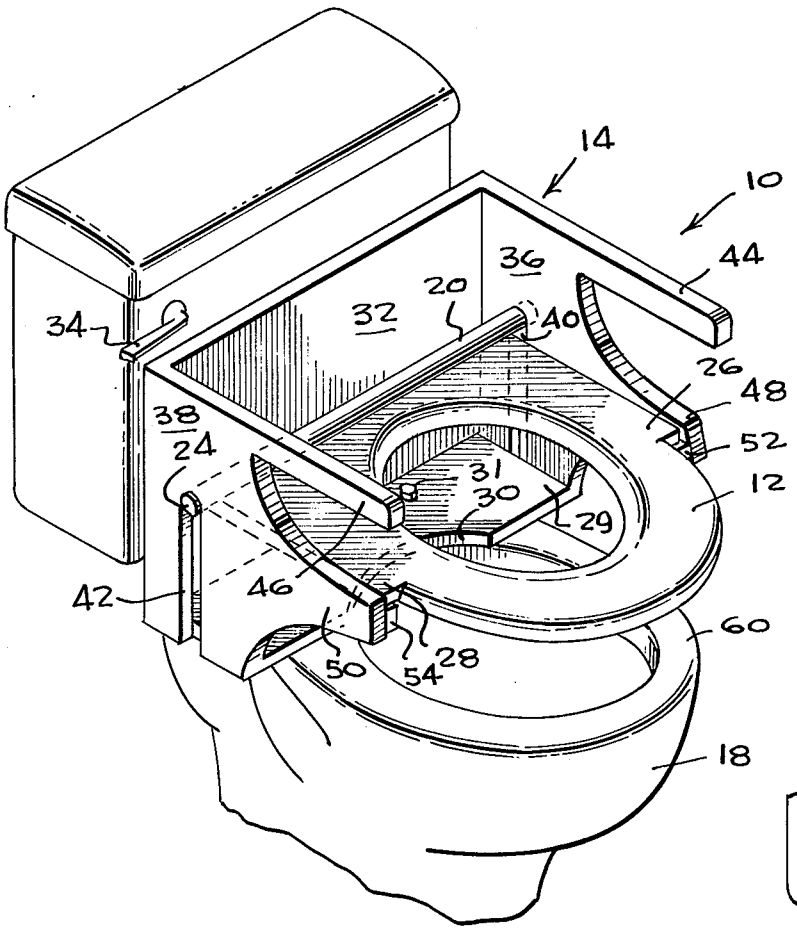
FIG. 1 is a perspective view of a preferred embodiment of the present invention with the closet seat of the closet seat assembly raised to its elevated position.
Figure 4:
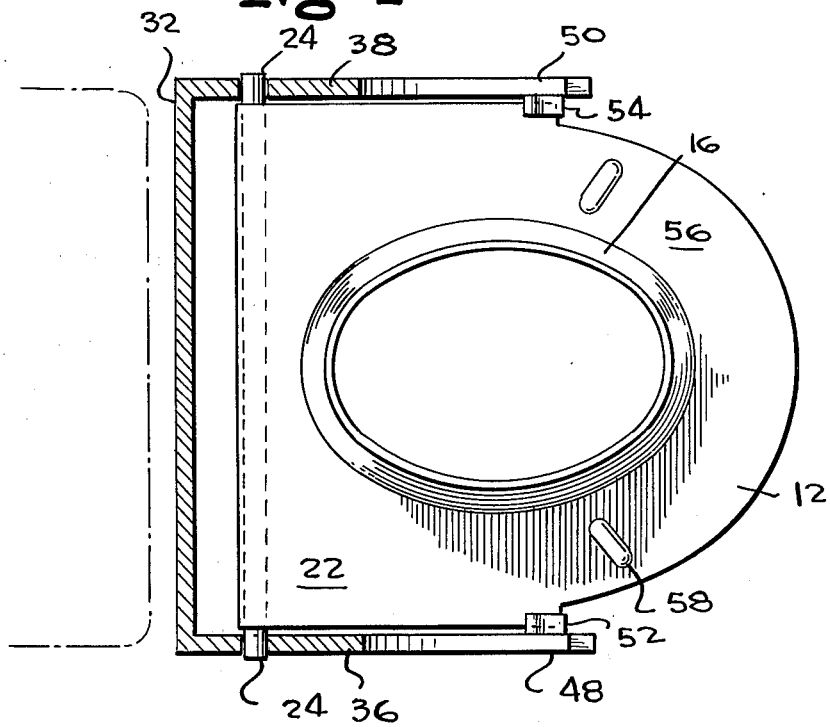
FIG. 4 is a fragmentary bottom view of the closet seat assembly taken along line 4—4 in FIG. 2 with the seat in the elevated position.

Referring in particular to FIGS. 1 and 3, it may be seen that the preferred embodiment of the present invention comprises a closet seat assembly shown generally at 10 which includes a closet seat 12 and support structure 14.

As shown in the various figures, the closet seat 12 has a central opening surrounded by a downwardly directed flange portion 16 (not shown in FIG. 1 for clarity) which is directly above the receptacle of the water closet 18 in both the conventional position and the elevated position. While the forward portion of the closet seat 12 and the central opening are of conventional configuration, the closet seat has a lateral guidebar 20 rigidly attached as by bolting or bonding to the rear portion 22 of the closet seat and extends outwardly beyond the edges of the closet seat. The ends of the guide bar 20 form guidepins 24 to provide guides and pivots for the closet seat. Side extensions 26 and 28 of the closet seat extend outwardly from the sides of the conventional closet seat configuration to provide support lips. In the preferred embodiment, the side extensions 26 and 28 extend parallel rearwardly to the lateral guidebar 20 to provide a neat appearance for the closet seat assembly and to make the assembly easy to clean.

The support structure 14 for the closet seat includes a mounting plate 29 of rectangular configuration with a semi-circular cutout 30 (shown in FIG. 1) to prevent obstruction of the water closet receptacle. Mounting bolts 31 are provided in suitable holes in the mounting plate 29 and are aligned with the mounting holes of the conventional water closet 18 to permit attachment of the mounting plate and the water closet assembly to the water closet. The mounting bolts 31 extend through the mounting bolt holes in the mounting plate 29 and the mounting holes in the rear of the water closet in a manner similar to conventional seats.

A rectangular rear support wall 32 having a lower edge coextensive with the rear edge of the mounting plate 29 and rigidly attached thereto as by screws or adhesive extends vertically upwardly to a height below the release handle 34 of the water closet. If the rear support wall extends above the release handle 34, it may interfere with the operation of the release handle.

An appropriate clearance or cutout (not shown) could be provided if the rear wall so extends above the release handle.

Figure 5:
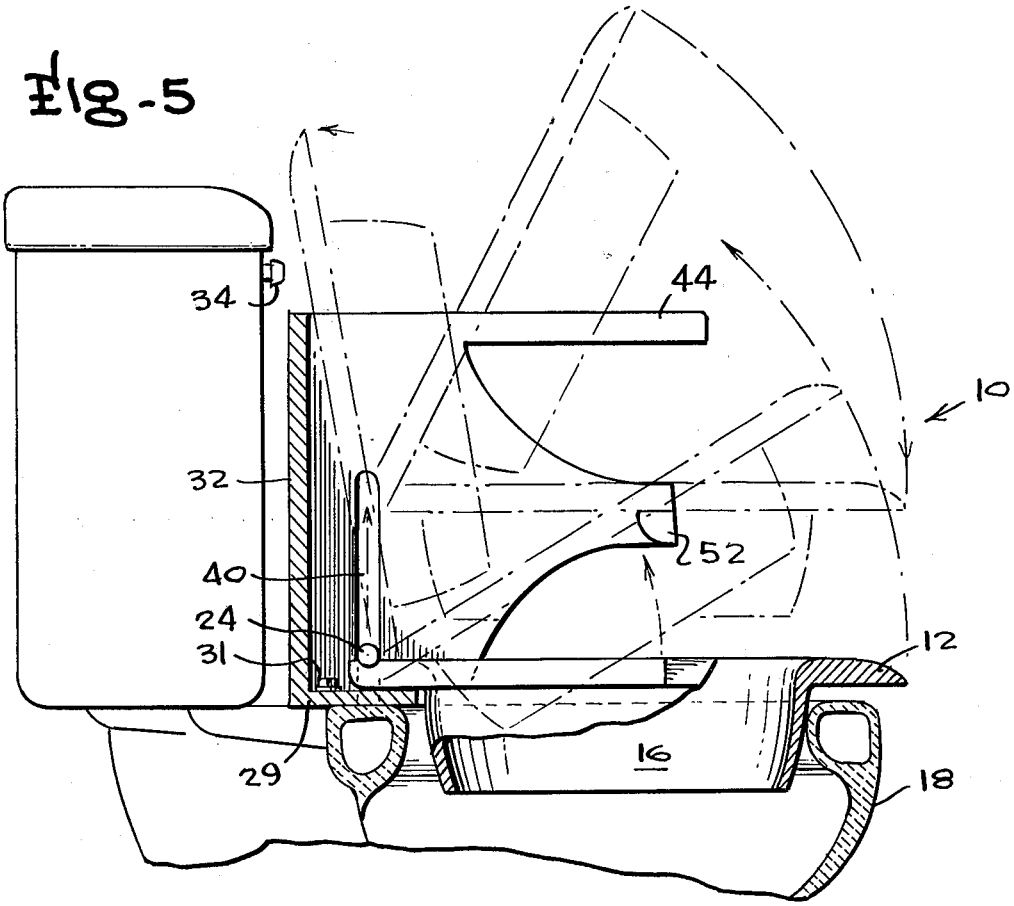
FIG. 5 is a fragmentary side view of the closet assembly shown in FIG. 1 illustrating the closet seat in the raised position, the lowered position and the intermediate positions through which it moves when being raised or lowered.

The support structure 14 has side support walls 36 and 38 with lower edges coextensive with the ends of the mounting plate 29 and with rear edges coextensive with the ends of the rear support wall 32. The side support walls are rigidly attached such as by screws or adhesive to the mounting plate 29 and the rear support wall 32. A guideway 40 in the form of a slot in the side support wall 36 extends from the lower edge of the side support wall and an opposed guideway 42 of similar form extends from the lower edges of the side support wall 38 to a predetermined height above the mounting plate 29 to receive and retain the guidepins 24. The guideways 40 and 42 are slightly wider than the diameter of the guidepins to prevent any horizontal movement of the closet seat 12 while providing easy vertical movement of the guidepins when the closet seat is raised to or lowered from its elevated position to the conventional position and permitting the closet seat to be tilted as shown in FIG. 5 when access to the receptacle is required.

Extending forwardly and forming a continuation of the upper edges of the side support walls 36 and 38 are arm rests 44 and 46 which provide support for the arms of the user who may be an invalid or sick person requiring such support to prevent falls from the closet seat. The arm rests may be contoured and padded as desired for the comfort and safety of the user. If desired, the arm rests may depend from separate support structure; however, the preferred embodiment provides a simple and easily cleaned assembly.

Figure 2:
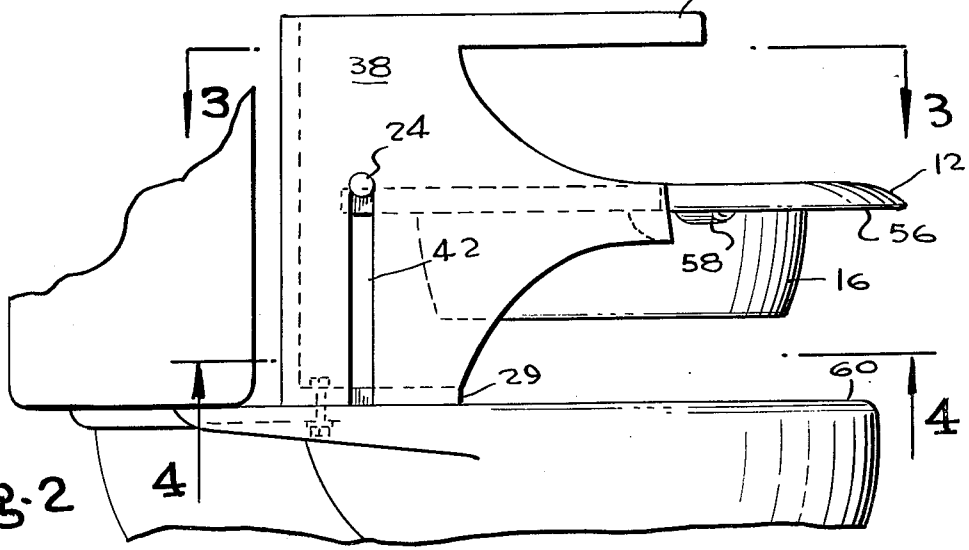
FIG. 2 is a side view of the closet seat assembly shown in FIG. 1 with the closet seat raised to its elevated position.

A support member 48, which in the preferred embodiment as shown in the figures is a continuation of side support wall 36, extends outwardly from the forward edge of the side support wall 36 and a similar support member 50 extends outwardly from the forward edge of the side support wall 38 at a height approximately equal to the height of the guideways 40 and 42. A closet seat support protrusion 52 extends inwardly from the support member 48 and an opposed closet seat support protrusion 54 extends inwardly from the support member 50 to underlie the support lips 26 and 28 respectively when the closet seat 12 is raised to the elevated position as particularly shown in FIGS. 1 and 2. The closet seat support protrusions 52 and 54 are positioned adjacent the forward edges 62 and 64 (shown in FIG. 3) of the support lips 26 and 28 and are of relatively narrow width to permit the lowering of the closet seat from the elevated position to the conventional position as shown in FIG. 5.

The underside 56 of the closet seat is flat and may be provided with conventional resilient bumpers 58 positioned to rest upon the upper rim 60 of the water closet 18.

One of the important aspects of the present invention is the relationship between the location of the guideways 40 and 42 and the position of the closet seat protrusions 52 and 54. As shown in FIG. 5, when the closet seat is tilted upwardly with the guidepins 24 at the lower ends of guideways 40 and 42, the support lips 26 and 28 are able to clear the closet seat support protrusions 52 and 54 thereby permitting the closet seat to be tilted backwardly to the normal position of conventional closet seats to permit access for cleaning the receptacle and the underside 56 of the closet seat. From this tilted position, the closet seat may be raised upwardly to move the guidepins 24 to the top of the guideways 40 and 42. When, with the guidepins at the top of the guideways, the seat is tilted forwardly as shown in FIG. 5, the support lips 26 and 28 come to rest on the closet seat support protrusions 52 and 54 thereby providing the elevated position for persons unable to stoop to the lower conventional position of the closet seat. In both the elevated and conventional positions, the user of the water closet may rest his arms or hands on the arm supports 44 and 46 to steady himself and prevent any falls from the seat. Conventional locking devices could be added to prevent lowering of the guidepins 24 in the guideways 40 and 42 except when the locking devices were released.

The closet seat 12 and the support structure 14 are preferably fabricated of a material such as wood with a conventional stain resistant protective coating such as enamel or they may be molded of a conventional plastic material for ease of maintenance and attractiveness of appearance. If plastic materials are used, the side walls, back wall and mounting plate may be formed as a continuous support structure without corners to improve cleanability and sanitation.

As the foregoing description discloses, the closet seat assembly of the present invention provides a closet seat which may be used in a conventional manner or raised to the elevated position as desired. The device is simple to use and easy to keep clean.

From the foregoing detailed description, it will be evident that there are a number of changes, adaptations and modifications of the present invention which come within the province of those skilled in the art. One such modification would be to add a conventional closet seat cover pivotted to the rear of the closet seat 12 to provide an attractive appearance and to close the receptacle of the water closet except when it is being used. It is intended that all such variations, not departing from the spirit of the invention be considered as within the scope thereof as limited solely by the depended claims.

I claim:

1. A closet seat assembly providing the conventional position and an elevated position of the seat for use on the receptacle of a water closet with the closet seat tiltable rearwardly, said seat assembly comprising a support structure, connecting means for attaching said support structure to the water closet, a closet seat having a central opening providing access to said receptacle, a means operatively connected between the seat and support structure for moving the closet seat from the conventional position to the elevated position, means integral with the moving means for permitting the closet seat to be tilted rearwardly to provide easy access to the receptacle for cleaning and the like and a positioning means on the support structure for engagement with a portion of the closet seat to maintain said seat in the elevated position.

2. The closet seat assembly of claim 1 wherein the central opening in the closet seat is surrounded by a downwardly projecting flange which extends into the receptacle of the water closet when the seat is in the conventional position to provide a splash guard when the closet seat is raised to the elevated position.

3. The closet seat assembly of claim 1 wherein the support structure has arm rests on opposite sides of the receptacle to provide support for the arms of the user.

4. A closet seat assembly of claim 1 wherein the support structure includes a mounting plate having mounting holes spaced to align with the mounting bolt holes on a conventional water closet, a rear wall having a lower edge co-extensive with and attached to the rear edge of the mounting plate and side support walls attached to the end edges of the mounting plate and the end edges of the rear support wall.

5. A closet seat assembly providing the conventional position and an elevated position of the seat for use on the receptacle of a water closet, said seat assembly comprising a support structure having a guideway, connecting means for attaching said support structure to the water closet, a closet seat having a central opening providing access to said receptacle, said closet seat having a guide movable along the guideway, and a positioning means on the support structure for engagement with a portion of the closet seat to maintain said seat in the elevated position, said positioning means including a protrusion on the support structure directed inwardly from a side of the receptacle at a predetermined height above the receptacle with said protrusion positioned to clear the closet seat when the guide on the closet seat is lowered on the guideway thereby permitting the closet seat to be moved to the conventional position adjacent the receptacle.

6. The closet seat assembly of claim 5 wherein the mounting means comprises bolts extending through the mounting bolt holes in the mounting plate and the mounting bolt holes of the water closet.

7. The closet seat assembly of claim 5 wherein the guideway includes opposed generally vertical slots in the side walls and the guide on the closet seat includes outwardly extending pins which are movable in the slots in the side walls.

8. A closet seat assembly providing the conventional position and an elevated position of the closet seat for use on the receptacle of a water closet having mounting bolt holes, said seat assembly comprising a rectangular mounting plate having mounting bolt holes spaced to align with the mounting bolt holes on the water closet, a rectangular rear wall having a lower edge coextensive with the rear edge of the mounting plate and attached thereto, said support walls attached to the end edges of the mounting plate and the end edges of the rear support wall, said side support walls having opposed vertical guideways therein extending to a predetermined height above the mounting plate, seat support members projecting forwardly from the side support walls and at a height equal to the top of the guideways, said seat support members having inwardly projecting closet seat support protrusions, a closet seat having a central opening therein surrounded by a downwardly projecting flange portion, said closet seat having outwardly projecting guidepins retained by and slidable in the guideways, said closet seat having outwardly directed lips on a portion of the side edges of the closet seat which engage the protrusions on the seat support members when the seat is in the elevated position and clear the protrusion when the closet seat is tilted rearwardly and the guides are moved to the bottom of the guideways which permits the closet seat to be lowered to the conventional position adjacent the upper surface of the water closet receptacle.

9. The closet seat assembly of claim 8 including arm rests projecting forwardly from the side support walls.

10. The closet seat assembly of claim 1 wherein the moving means includes two opposed generally vertical slots in the support structure and a guide on the closet seat including outwardly extending pins which are movable in the slots in the support structure thereby providing the means for permitting the seat to be tilted rearwardly.

11. The closet seat assembly of claim 10 wherein the slots are on opposite sides of the receptacle with the slots opening toward the receptacle and wherein the guide pins extend horizontally outward from the closet seat to engage each of the slots thereby providing the means for permitting the closet seat to be tilted rearwardly as the pins rotate in the slot and the closet seat is lifted.

12. The closet seat assembly of claim 1 wherein the positioning means comprises a protrusion on the support structure with said protrusion positioned to clear the closet seat when the closet seat is lowered from the elevated position thereby permitting the closet seat to be moved to the conventional position adjacent the receptacle.

13. The closet seat assembly of claim 12 wherein said protrusion is directed inwardly from a side of the receptacle at a predetermined height above the receptacle.

14. The closet seat of claim 1 wherein the moving means includes a guideway on the support structure and a guide on the closet seat movable along the guideway and wherein the positioning means comprises a protrusion on the support structure with said protrusion positioned to clear the closet seat when the guide on the closet seat is lowered on the guideway thereby permitting the closet seat to be moved to the conventional position adjacent the receptacle.

* * * * *